US009640128B2

(12) United States Patent
Xu

(10) Patent No.: US 9,640,128 B2
(45) Date of Patent: May 2, 2017

(54) GAMMA VOLTAGE TUNING METHOD AND GAMMA VOLTAGE TUNING SYSTEM

(71) Applicants: BOE TECHNOLOGY GROUP CO., LTD., Beijing (CN); HEFEI BOE OPTOELECTRONICS TECHNOLOGY CO., LTD., Hefei, Anhui (CN)

(72) Inventor: Xiangyang Xu, Beijing (CN)

(73) Assignees: BOE TECHNOLOGY GROUP CO., LTD., Beijing (CN); HEFEI BOE OPTOELECTRONICS TECHNOLOGY CO., LTD., Hefei, Anhui (CN)

( * ) Notice: Subject to any disclaimer, the term of this patent is extended or adjusted under 35 U.S.C. 154(b) by 218 days.

(21) Appl. No.: 14/377,774

(22) PCT Filed: Oct. 25, 2013

(86) PCT No.: PCT/CN2013/086007

§ 371 (c)(1),
(2) Date: Aug. 8, 2014

(87) PCT Pub. No.: WO2014/194603

PCT Pub. Date: Dec. 11, 2014

(65) Prior Publication Data

US 2016/0196793 A1 Jul. 7, 2016

(30) Foreign Application Priority Data

Jun. 5, 2013 (CN) ..... 2013 1 0222327

(51) Int. Cl.
*G09G 5/10* (2006.01)
*G09G 3/36* (2006.01)
(Continued)

(52) U.S. Cl.
CPC ..... *G09G 3/3688* (2013.01); *G09G 3/2096* (2013.01); *G09G 3/3413* (2013.01);
(Continued)

(58) Field of Classification Search
CPC .. G09G 3/3688; G09G 3/3413; G09G 3/2096; G09G 3/3607; G09G 2310/0286;
(Continued)

(56) References Cited

U.S. PATENT DOCUMENTS

2008/0158240 A1 7/2008 Huang et al.
2009/0096819 A1 4/2009 Kinoshita
(Continued)

FOREIGN PATENT DOCUMENTS

CN 101414447 A 4/2009
CN 103310752 A 9/2013

OTHER PUBLICATIONS

International Preliminary Report on Patentability issued Dec. 8, 2015; PCT/CN2013/086007.
(Continued)

*Primary Examiner* — Rodney Amadiz
(74) *Attorney, Agent, or Firm* — Ladas & Parry LLP

(57) ABSTRACT

Provided are a Gamma voltage tuning method and a Gamma voltage tuning system. The method includes: dividing a display panel into at least two display areas; and for each divided display panel, controlling a gate driving integrated circuit to drive multiple gate lines in the display area in turn and a data driving integrated circuit to drive data lines in the display area simultaneously to lighten pixels in the display area, and performing a Gamma voltage tuning on the display area whose pixels are lightened. The display panel is divided into display areas and the tuning of Gamma voltage values is performed for each divided display area respectively; therefore the tuning of Gamma voltage for large size display
(Continued)

panels is more accurate, which can effectively improve the uniformity of the picture display.

12 Claims, 4 Drawing Sheets

(51) Int. Cl.
*G09G 3/20* (2006.01)
*G09G 3/34* (2006.01)

(52) U.S. Cl.
CPC ..... *G09G 3/3607* (2013.01); *G09G 3/3611* (2013.01); *G09G 2300/0408* (2013.01); *G09G 2310/027* (2013.01); *G09G 2310/0286* (2013.01); *G09G 2310/0291* (2013.01); *G09G 2320/0242* (2013.01); *G09G 2320/0646* (2013.01); *G09G 2320/0673* (2013.01); *G09G 2320/0686* (2013.01)

(58) Field of Classification Search
CPC ..... G09G 2300/0408; G09G 2310/027; G09G 2320/0673; G09G 2320/0646; G09G 2310/0291; G09G 2320/0242; G09G 3/3611; G09G 2320/0686
See application file for complete search history.

(56) References Cited

U.S. PATENT DOCUMENTS

2015/0287385 A1* 10/2015 Wu ..... G09G 5/10 345/691
2015/0364095 A1* 12/2015 Zhang ..... G09G 3/3426 345/690

OTHER PUBLICATIONS

First Chinese Office Action Appln. No. 201310222327.9; Dated Nov. 26, 2014.
International Search Report Appln. No. PCT/CN2013/086007; Dated Mar. 13, 2014.

* cited by examiner

GAMMA VOLTAGE TUNING METHOD AND GAMMA VOLTAGE TUNING SYSTEM

TECHNICAL FIELD OF THE DISCLOSURE

The present disclosure relates to the field of liquid crystal display technology, and particularly to a Gamma voltage tuning method and a Gamma voltage tuning system.

BACKGROUND

A Liquid Crystal Display (LCD) has been widely used due to its advantages such as thin volume, lightness and low electromagnetic radiation. A configuration of a LCD panel is as shown in FIG. 1, which comprises a display panel (an array substrate 101, a color film substrate 102 and the liquid crystal), a data driving integrated circuit (Data IC) 103, a gate driving integrated circuit (Gate IC) 104, a Flexible Printed Circuit Board (FPC) 105 and a Printed Circuit Board (PCB) 106. Its operation principle is as follows. Signals output by the system (such as a Transistor Transistor Logic (TTL)/Low-Voltage Differential Signaling (LVDS), and so on) enter the Data IC and a power unit via a connector on the PCB so as to generate signals that the Gate IC and Data IC can recognize, including a synchronous signal, an analog signal Gamma voltage and a digital signal (TTL/mini-LVD), etc. These signals will be output to the LCD panel after being processed by the Gate IC and the Data IC, so as to control the liquid crystal panel to display.

The Gate IC essentially is a shift register, and its main function is to perform a progressive scan on the liquid crystal panel. The Data IC essentially is a digital-to-analog converter (DAC), and its main function is to convert the digital mini-LVDS signal generated by a Timing Controller (T-con) into an analog signal corresponding to the gray scale voltage by using a Gamma voltage output on the PCB and input the same to the LCD panel, as shown in FIG. 2.

The above Gamma voltage is generated by a Gamma reference voltage generation circuit, and the Gamma reference voltage generation circuit is designed based on an ideal gray scale-voltage (L-V) curve. However, in practice, due to effects of various factors such as a gravity, a process uniformity, a path loss, a backlight uniformity and so on on the display panel, although the Gamma reference voltage generation circuit may improve a display effect of the display panel, the actual display effect of the fabricated display panel usually cannot reach an ideal display effect.

For the LCD, the voltage (V) between an upper plate and a lower plate of the LCD panel does not have a linear relationship with a light transmittance (T); therefore, in order to correct this variation, it is necessary to change a voltage output by the Data IC. The Data IC essentially is the digital-to-analog converter, and its output analog voltage is determined by the Gamma voltage and corresponding gray scale bit(s). However, the gray scale bit(s) is a fixed value, so it can only change the Gamma voltage in order to change the output voltage. Therefore, when a pixel data of a digital picture to be displayed is to be converted into the voltage signal input to two sides of the liquid crystal, an action of tuning the Gamma voltage must be performed to relieve a display non-uniformity and a color cast phenomenon.

When the generation of the Gamma voltage is realized by voltage distribution of a Gamma resistor string as shown in FIG. 3, it is possible to tune the voltage of the Gamma resistor series to perform Gamma tuning.

When the generation of the Gamma voltage is realized by a programmable Gamma device as shown in FIG. 4, assuming that the display panel has a uniform brightness of the display under different gray scales, it is possible to test the brightness at a center point of the display panel and tune the Gamma voltage by using test values. When such a method is used to tune the Gamma voltage for small size LCE panels, since the influences of the gravity, the process uniformity, the path loss, the backlight uniformity on it are negligible (the small size LCD panels can be regarded to have the uniform process and the uniform backlight), the picture display has a good uniformity after Gamma tuning is performed by using such a method. However, for large size LCD panels, since the influences of various factors such as the gravity, the process uniformity, the path loss, the backlight uniformity and so on are not negligible, when the above method is still used to perform the Gamma tuning, phenomenons of the display non-uniformity and color cast in the picture display would occur in the LCD panel.

SUMMARY

Embodiments of the present disclosure provide a Gamma voltage tuning method and a Gamma voltage tuning system to solve the problem of non-uniformity in the picture display occurred when the Gamma voltage tuning method in the prior art is used for large size display panels.

A Gamma voltage tuning method, comprising:

dividing a display panel into at least two display areas, and performing following operations for each divided display panel:

controlling a gate driving integrated circuit to drive multiple gate lines in the display area in turn, and a data driving integrated circuit to drive data lines in the display area simultaneously, to lighten pixels in the display area; and performing a Gamma voltage tuning on the display area in which the pixels are lightened.

A Gamma voltage tuning system, comprising:

an area dividing apparatus configured to divide a display panel into at least two display areas;

a control system configured to, for each divided display panel, control a gate driving integrated circuit to drive multiple gate lines in the display area in turn and a data driving integrated circuit to drive data lines in the display area simultaneously in order to lighten pixels in the display area, and perform a Gamma voltage tuning on the display area in which the pixels are lightened.

In solutions of embodiments of the present disclosure, since the display panel is divided into the display areas and the tuning of Gamma voltage values is performed for each divided display area respectively, the tuning of Gamma voltage for the large size display panels is more accurate, which can effectively improve the uniformity of the picture display.

DETAILED DESCRIPTION

In the following, embodiments of the present disclosure are described in connection with figures. It is noted that the embodiments described herein are only for describing and explaining the present disclosure, but not for limiting the present disclosure.

In the following, the technical solutions of embodiments of the present disclosure are described in detail.

First Embodiment

Figure 5:
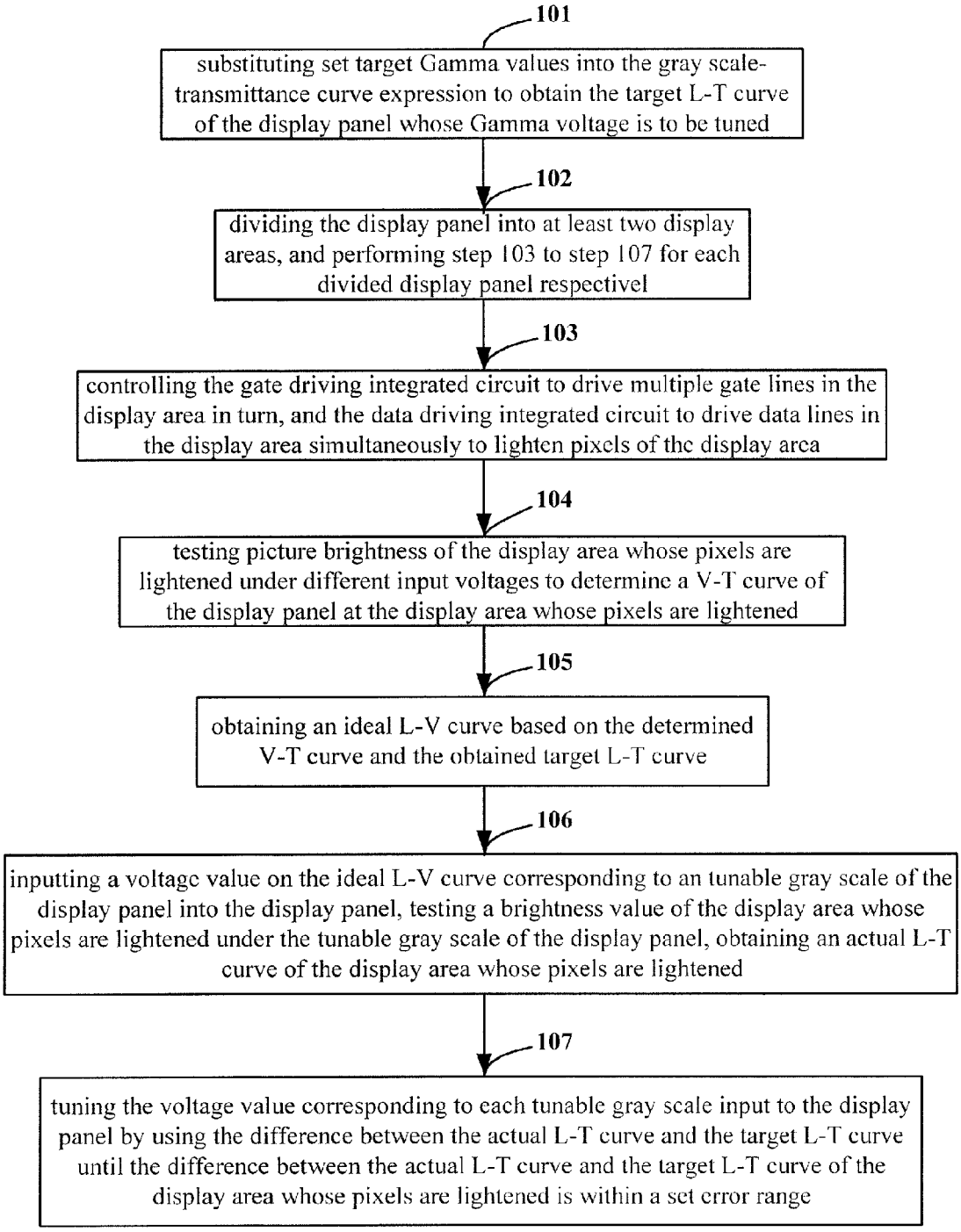
FIG. 5 is a flowchart for a Gamma voltage tuning method in a first embodiment of the present disclosure.

As shown in FIG. 5, a flowchart of a Gamma voltage tuning method in the first embodiment of the present disclosure is shown, which comprises the following steps.

At step 101, a set target Gamma value is substituted into a formula (1) to obtain a target gray scale-transmittance L-T curve of a display panel whose Gamma voltage is to be tuned.

$$T=T_0+(L/M)^{Gamma}\times(T_M-T_0) \quad (1)$$

Formula (1) is a curve relationship expression between gray scales and transmittances, wherein L denotes the gray scale, M denotes a maximum value of the gray scale L, $T_0$ denotes a transmittance of the darkest scale, and $T_M$ denotes the transmittance of a brightest scale.

At step 102, the display panel is divided into at least two display areas, and step 103 to step 107 are performed for each divided display panel respectively.

In an example, at step 102, the display panel is divided into the at least two display areas based on a brightness uniformity of the display panel, wherein the worse the brightness uniformity is, the more a number of the divided display areas is. The brightness uniformity indicates a difference among different brightness under a same gray scale.

In an example, considering that the display panel achieves the picture display under the common control of both row scan signals (for controlling the display of rows of the display panel) output by the gate driving integrated circuit and data signals (for controlling the display of columns of the display panel) in form of analog voltage output by the data driving integrated circuit, in order to facilitate controlling the display panel to perform the picture display and subsequent measurements, a shape of the divided display area is a square or a rectangle.

Figure 6:
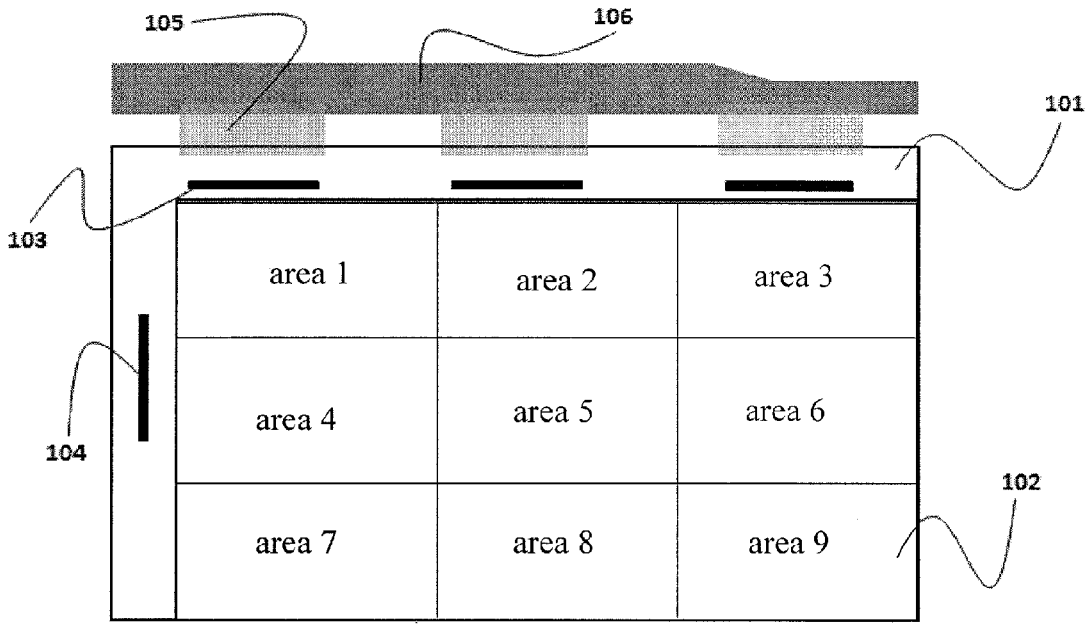
FIG. 6 is a schematic diagram for area division of the display panel in the first embodiment of the present disclosure.

The division of the display areas may be as shown in FIG. 6. In FIG. 6, the display panel is divided into 9 display areas, which are an area 1, an area 2, an area 3, an area 4, an area 5, an area 6, an area 7, an area 8 and an area 9 respectively. All the areas have the same size and are all rectangles. In general, an existing large size display panel can be divided into 9 display areas. The manner of dividing the display areas may be set depending on requirements, and may be the same or different. Preferably, each area is parallel to the gate line.

At step 103, the gate driving integrated circuit is controlled to drive multiple gate lines in the display area in turn, and the data driving integrated circuit is controlled to drive data lines in the display area simultaneously, in order to lighten pixels in the display area.

The lightening of the display panel is realized by both the scan signals output by the gate driving integrated circuit and the analog signals output by the data driving integrated circuit. In order to accurately drive the gate driving integrated circuit and the data driving integrated circuit, a synchronous signal output by a time sequence controller is used for controlling.

At step 104, picture brightnesses of the display area whose pixels are lightened under different input voltages are tested to determine a voltage-transmittance V-T curve of the display panel at this display area whose pixels are lightened.

At step 104, a testing apparatus can be used to provide the display panel with the different input voltages and perform a brightness collection for the pictures under the different voltages so as to obtain multiple groups of voltage-brightness data pairs. The obtained brightness divided by the maximum brightness is the transmittance. Then it is possible to convert the multiple groups of voltage-brightness data pairs into voltage-transmittance data pairs. A curve fitting is performed on the obtained multiple groups of voltage-transmittance data pairs, to obtain the V-T curve of the display panel at the display area whose pixels are lightened.

The V-T curve refers to a voltage versus transmittance curve. Different liquid crystals have different transmittances under the same voltage, which is an operation principle of a liquid crystal light valve. In other words, the different liquid crystals have the different V-T curves. For one certain type of liquid crystal, the V-T curve is fixed. However, the voltage output from the gate driving integrated circuit to a liquid crystal capacitor still has loss which is caused by a path load, so if the path load is too large, the voltage applied on the display panel would be too small, and in turn the transmittance would change. The first embodiment of the present disclosure considers that a large size LCD has different path losses at different display areas; therefore, in different display areas of the display panel, the actual V-T curves are not only different from the above V-T curve corresponding to one certain type of liquid crystal, but also different from each other. Therefore, in the first embodiment of the present disclosure, dividing the display panel into at least two display areas improves the accuracy of the Gamma voltage tuning to some extent, and improves the picture display quality of the display panel.

At step 105, an ideal gray scale-voltage L-V curve is obtained based on the determined V-T curve and the obtained target L-T curve.

At step 105, voltage-transmittance data pairs, such as (V0, T0), (V1, T1), (V2, T2) and so on, can be obtained from the determined V-T curve; gray scale-transmittance data pairs, such as (L0, T0), (L1, T1), (L2, T2) and so on, can be obtained from the target L-T curve; and gray scale-voltage data pairs, such as (L0, V0), (L1, V1), (L2, V2) and so on, can be obtained by assigning the same transmittances, that is, the ideal L-V curve is obtained.

At step 106, a voltage value in the ideal L-V curve corresponding to an tunable gray scale of the display panel is input into the display panel, a brightness value of the display area whose pixels are lightened under the tunable gray scale of the display panel is tested, and the brightness value is divided by a maximum brightness to obtain an actual L-T curve of the display area whose pixels are lightened.

In practical testing, a brightness of a center point in the display area whose pixels are lightened is tested. Because the display area whose pixels are lightened has the small size relative to the entire display panel, the influences of the gravity, the process uniformity, the path loss and the backlight source on the display area can be considered to be uniform, that is, in the display area whose pixels are lightened, it can be regarded that the process is uniform, the backlight source is uniform and the path loss is the same. Therefore, in the first embodiment of the present disclosure, it improves the accuracy of the Gamma voltage tuning and the picture display quality of the display panel by dividing the display panel into at least two display areas, testing the actual L-T curve of each display area, and comparing the actual L-T curve obtained by testing with the target L-T curve in the subsequent steps to tune the Gamma voltage value.

In addition, it is also possible to take an average of the brightness of all or part of the pixels within the display area whose pixels are lightened as the brightness of the display area.

At step 107, the voltage value corresponding to each tunable gray scale input to the display panel is tuned by using the difference between the actual L-T curve and the target L-T curve until the difference between the actual L-T curve and the target L-T curve is within a set error range.

The above steps 103 to 107 are the tuning process for the Gamma voltage of the display area whose pixels are lightened.

Figure 1:
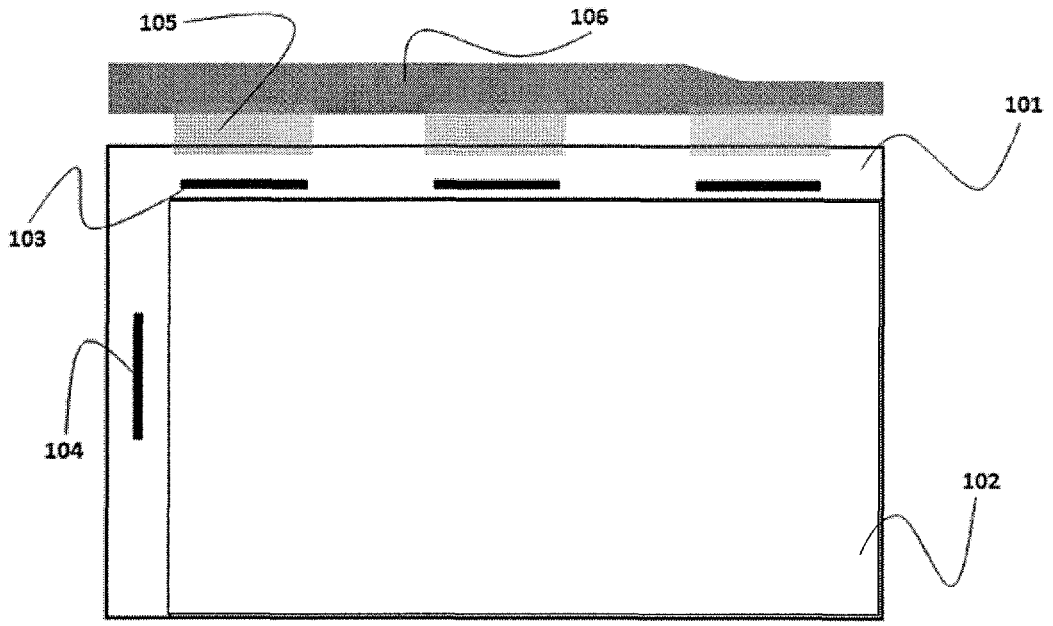
FIG. 1 is a schematic structural diagram of a configuration of a LCD panel in the background technology.
Figure 2:
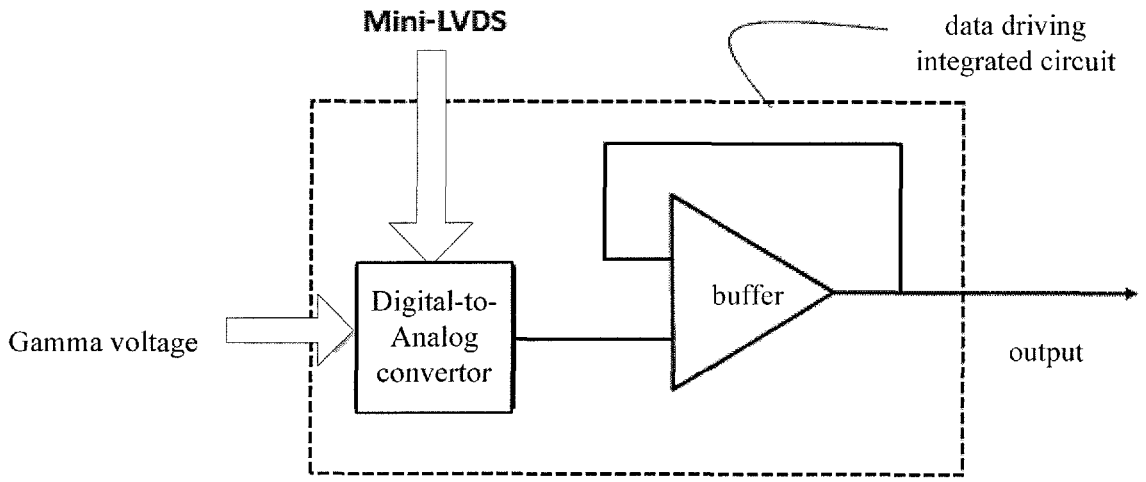
FIG. 2 is a schematic functional diagram of a data integrated circuit in the background technology.
Figure 3:
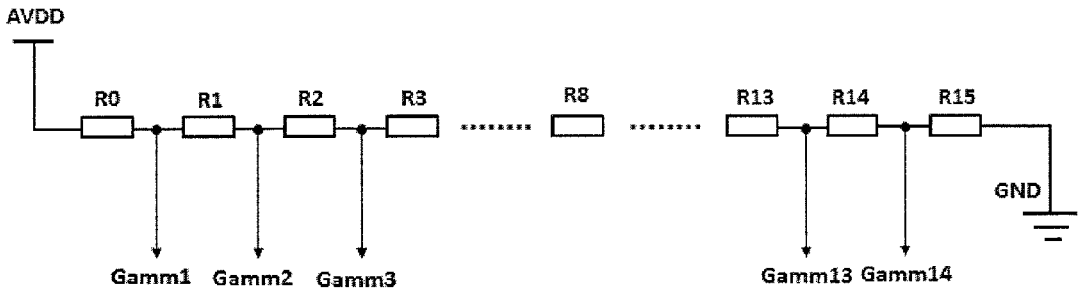
FIG. 3 is a circuit diagram for generating Gamma voltages using a Gamma resistor series in the background technology.
Figure 4:
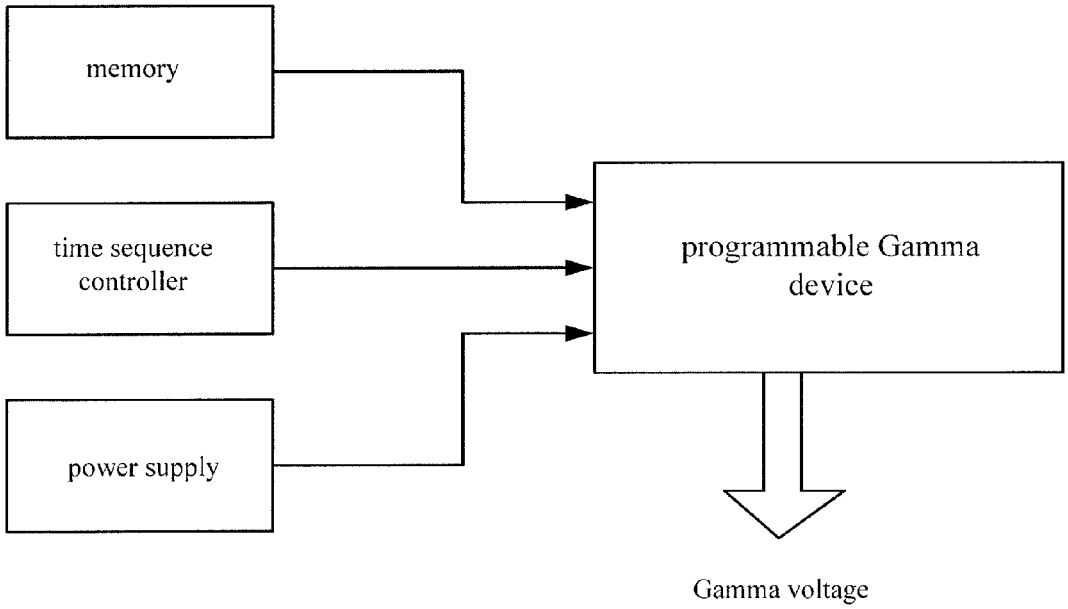
FIG. 4 is schematic diagram for generating Gamma voltages using a programmable Gamma device in the background technology.

In a practical implementation process, with reference to FIG. 4, the actual L-T curve and the target L-T curve data can be stored in a memory, and the data of the display area corresponding to the actual L-T curve and the target L-T curve can be stored in the memory. A time sequence controller generates a display area synchronous signal and transmits the same to a programmable Gamma device which tunes the voltage value corresponding to each tunable gray scale input to the display panel. The area synchronous signal contains information of the display areas divided from the display panel such that the programmable Gamma device can output the tuned Gamma voltage for the display area whose pixels are lightened based on the display area synchronous signal.

In the solution of the first embodiment of the present disclosure, since the display panel is divided into the display areas based on the brightness uniformity of the display panel and the tuning of Gamma voltage values is performed for each divided display area respectively, the tuning of Gamma voltage for the large size display panels is more accurate, which can effectively improve the uniformity of the picture display.

Second Embodiment

Figure 7:
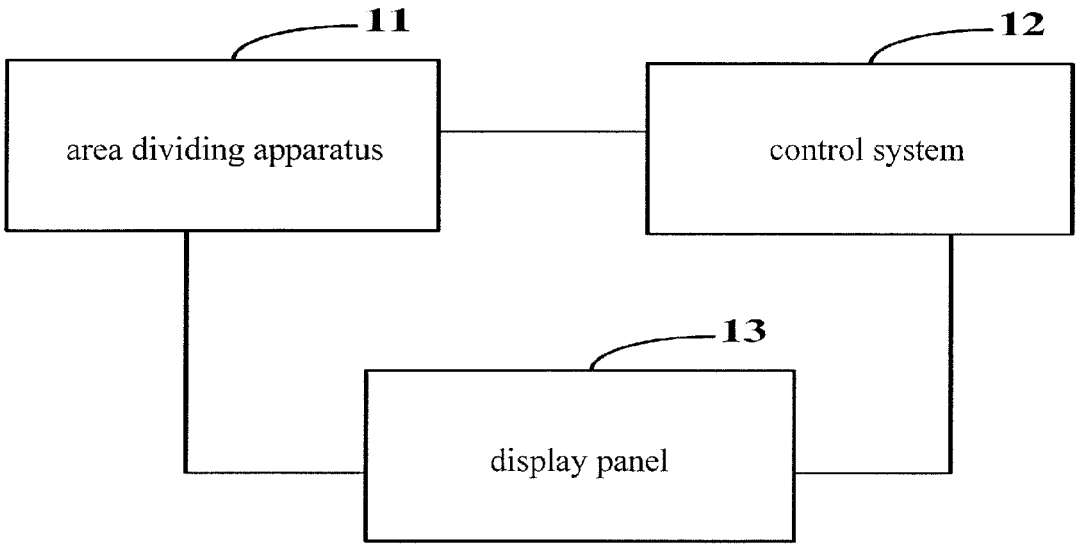
FIG. 7 is a schematic structural diagram of a Gamma voltage tuning system in a second embodiment of the present disclosure.

Based on the same concept with the first embodiment of the present disclosure, the second embodiment of the present disclosure provides a Gamma voltage tuning system whose schematic structural diagram is as shown in FIG. 7, comprising an area dividing apparatus 11, a control system 12 and a display panel 13, wherein the area dividing apparatus 11 is configured to divide a display panel into at least two display areas; and the control system 12 is configured to, for the each divided display panel, control a gate driving integrated circuit of the display panel to drive multiple gate lines in the display area in turn and a data driving integrated circuit to drive data lines in the display area simultaneously to lighten pixels in the display area, and is configured to perform a Gamma voltage tuning on the display area in which pixels are lightened.

In an example, the control system 12 specifically comprises:

a processing apparatus configured to: for the each divided display panel, control the gate driving integrated circuit to drive the multiple gate lines in the display area in turn and the data driving integrated circuit to drive data lines in the display area simultaneously to lighten the pixels in the display area; obtain an ideal gray scale-voltage L-V curve based on a determined voltage-transmittance V-T curve and a target gray scale-transmittance L-T curve which is obtained by substituting set target Gamma values into a curve relationship expression between the gray scales and the transmittances; input a voltage value in the ideal L-V curve corresponding to an tunable gray scale of the display panel into the display panel to obtain an actual L-T curve; tuning the voltage value corresponding to each tunable gray scale input to the display panel by using differences between the actual L-T curve and the target L-T curve until the difference between the actual L-T curve and the target L-T curve of the display area whose pixels are lightened is within a set cast range; and a testing apparatus configured to: test picture brightness of the display area whose pixels are lightened under different input voltages; determine the voltage-transmittance V-T curve of the display panel at the display area whose pixels are lightened; and test brightness values of the display area whose pixels are lightened under different gray scales and dividing the brightness values by a maximum brightness to obtain the actual L-T curve of the display area whose pixels are lightened.

The processing apparatus can be a programmable Gamma device in the first embodiment.

The area dividing apparatus 11 is specifically configured to divide the display panel into at least two display areas based on the brightness uniformity of the display panel, wherein the worse the brightness uniformity is, the more a number of the divided display areas is, and the brightness uniformity indicates the difference among different brightness under the same gray scale.

Preferably, the area dividing apparatus 11 is specifically configured to divide the display panel into at least two display areas which have a shape of square or rectangle.

Preferably, the area dividing apparatus 11 is specifically configured to divide the display panel into 9 display areas.

Those skilled in the art should understand that the embodiments of the present disclosure may be provided as a method, a system or a computer program product. Therefore, the present disclosure may utilize forms of complete hardware embodiments, complete software embodiments, or embodiments combining hardware and software. Moreover, the present disclosure may utilize a form of computer program products implemented on one or more computer usable storage media (including but not limited to a magnetic disc, CD-ROM, an optical memory, etc.) containing computer usable program codes.

The present disclosure is described by referring to flowchart and/or block diagram of the method, the device (system), and the computer program product according to the embodiments of the present disclosure. It should be understood that each process and/or block in the flowchart and/or the block diagram, and combinations of the processes and/or blocks in the flowchart and/or block diagram may be implemented by the computer program instructions. The computer program instructions may be provided to a general purpose computer, a dedicated purpose computer, an embedded processor or processors of other programmable data processing equipment to produce a machine, so that the instructions executed by the computers or the processors of other programmable data processing equipment may generate the apparatus for realizing the function(s) specified in the one or more processes in the flowcharts and/or one or more blocks in the block diagrams.

The computer program instructions may also be stored in a computer readable memory capable of booting the computer or other programmable data processing equipment to operate in a specific manner, so that the instructions stored on the computer readable memory may generate a product comprising an instruction apparatus, the instruction apparatus may realize the function(s) specified in the one or more processes in the flowcharts and/or one or more blocks in the block diagrams.

The computer program instructions may also be loaded into the computer or other programmable data processing equipment, which make the computer or other programmable data processing equipment perform a series of operation steps to generate processing implementable by the computer, so that the instructions executed on the computer or other programmable data processing equipment may provide steps for realizing the function(s) specified in the one or more processes in the flowcharts and/or one or more blocks in the block diagrams.

Although the preferred embodiments of the present disclosure have been described, those skilled in the art may make additional changes and modifications on these embodiments once they learn the basic inventive concept. Therefore the appended claims is intended to be explained as including the preferred embodiments and all changes and modifications falling into the scope of the present disclosure.

Obviously, those skilled in the art may make various changes and variations on the present disclosure without departing from the spirit and scope of the present disclosure. Thus, the present disclosure intends to cover the changes and variations to the present disclosure if such changes and variations belong to the scope defined by the claims of the present disclosure and equivalence thereof.

What is claimed is:

1. A gamma voltage tuning method, comprising:

dividing a display panel into at least two display areas, and performing following operations for each divided display panel:

controlling a gate driving integrated circuit to drive multiple gate lines in the display area in turn, and a data driving integrated circuit to drive data lines in the display area simultaneously to lighten pixels in the display area; and performing a voltage tuning on the display area in which the pixels are lightened;

wherein performing a gamma voltage tuning on the display area in which the pixels are lightened comprises:

testing a picture brightness of the display area in which the pixels are lightened under different input voltages to determine a voltage-transmittance V-T curve of the display panel at the display area in which the pixels are lightened;

obtaining an ideal gray scale-voltage L-V curve based on the determined voltage-transmittance V-T curve and a target gray scale-transmittance L-T curve, the target L-T curve is obtained by a curve relationship expression between gray scales and transmittances of set target gamma values;

inputting a voltage value on the ideal L-V curve corresponding to an tunable gray scale of the display panel into the display panel, testing a brightness value of the display area in which the pixels are lightened under the tunable gray scale of the display panel and dividing the brightness value by a maximum brightness to obtain an actual L-T curve of the display area in which the pixels are lightened; and tuning the voltage values corresponding to respective tunable gray scales input to the display panel by using differences between the actual L-T curve and the target L-T curve until the differences between the actual L-T curve and the target L-T curve of the display area in which the pixels are lightened is within a set error range.

2. The method according to claim 1, wherein the display panel is divided into the at least two display areas based on a brightness uniformity of the display panel, wherein a number of the divided display areas increases as the brightness uniformity worsens, and the brightness uniformity indicates a difference among the different brightness under the same gray scale.

3. The method according to claim 1, wherein a shape of the divided display area is a square or a rectangle.

4. The method according to claim 1, wherein the display panel is divided into 9 display areas.

5. The method according to claim 1, wherein a shape of the divided display area is a square or a rectangle.

6. The method according to claim 1, wherein the display panel is divided into 9 display areas.

7. A gamma voltage tuning system, comprising an area dividing apparatus, a control system and a display panel, wherein the area dividing apparatus is configured to divide a display panel into at least two display areas; and the control system is configured to, for the each divided display panel, control a gate driving integrated circuit of the display panel to drive multiple gate lines in the display area in turn and a data driving integrated circuit to drive data lines in the display area simultaneously to lighten pixels in the display area, and is configured to perform a gamma voltage tuning on the display area in which the pixels are lightened;

wherein the control system comprises:

a processing apparatus configured to: for the each divided display panel, control the gate driving integrated circuit to drive the multiple gate lines in the display area in turn and the data driving integrated circuit to drive the data lines in the display area simultaneously to lighten the pixels in the display area; obtain an ideal gray scale-voltage L-V curve based on a determined voltage-transmittance V-T curve and a target gray scale-transmittance L-T curve, the target L-T curve is obtained by substituting set target gamma values into a curve relationship expression between gray scales and transmittances; input a voltage value on the ideal L-V curve corresponding to an tunable gray scale of the display panel into the display panel to obtain an actual L-T curve; tune the voltage values corresponding to the respective tunable gray scales input to the display panel by using differences between the actual L-T curve and the target L-T curve until the differences between the actual L-T curve and the target L-T curve of the display area in which the pixels are lightened is within a set error range; and a testing apparatus configured to: test picture brightness of the display area in which the pixels are lightened under different input voltages; determine a voltage-transmittance V-T curve of the display panel at the display area in which the pixels are lightened; and test brightness values of the display area in which the pixels are lightened under different gray scales and dividing the brightness values by a maximum brightness to obtain the actual L-T curve of the display area in which the pixels are lightened.

8. The gamma voltage tuning system according to claim 7, wherein the area dividing apparatus is configured to divide the display panel into the at least two display areas based on a brightness uniformity of the display panel, wherein a number of the divided display areas increases as the brightness uniformity worsens, and the brightness uniformity indicates differences among the different brightness under the same gray scale.

9. The gamma voltage tuning system according to claim 7, wherein the area dividing apparatus is configured to divide the display panel into the at least two display areas having a shape of square or rectangle.

10. The gamma voltage tuning system according to claim 7, wherein the area dividing apparatus is configured to divide the display panel into 9 display areas.

11. The gamma voltage tuning system according to claim 7, wherein the area dividing apparatus is configured to divide the display panel into the at least two display areas having a shape of square or rectangle.

12. The gamma voltage tuning system according to claim 7, wherein the area dividing apparatus is configured to divide the display panel into 9 display areas.

* * * * *